US009913523B1

(12) United States Patent
Contag

(10) Patent No.: US 9,913,523 B1
(45) Date of Patent: Mar. 13, 2018

(54) UNIVERSAL NAIL POLISH STORAGE AND DISPLAY ASSEMBLY

(71) Applicant: Color Clutch, LLC, Miami, FL (US)

(72) Inventor: Katharine R. Contag, Miami, FL (US)

( * ) Notice: Subject to any disclaimer, the term of this patent is extended or adjusted under 35 U.S.C. 154(b) by 126 days.

(21) Appl. No.: 14/789,084

(22) Filed: Jul. 1, 2015

Related U.S. Application Data

(60) Provisional application No. 62/044,640, filed on Sep. 2, 2014, provisional application No. 62/021,371, filed on Jul. 7, 2014.

(51) Int. Cl.
*A45D 29/20* (2006.01)

(52) U.S. Cl.
CPC ..... *A45D 29/20* (2013.01)

(58) Field of Classification Search
CPC ..... A45D 29/20; B65D 1/36
See application file for complete search history.

(56) References Cited

U.S. PATENT DOCUMENTS 1,945,792 A * 2/1934 Stephens ..... B65D 5/4204 206/769
2,172,262 A * 9/1939 Schinzel ..... G03C 1/815 430/507
2,219,597 A * 10/1940 Lutz ..... A45D 29/20 132/73
2,228,493 A * 1/1941 Will ..... A45C 11/34 206/214
2,750,028 A * 6/1956 Bode ..... F42B 39/26 206/3
3,207,302 A * 9/1965 Hobbs ..... A61M 5/002 206/366
3,285,411 A * 11/1966 English, Jr. ..... A23B 7/148 206/1.5
3,415,364 A * 12/1968 Schneider ..... B65D 81/113 206/524
3,421,679 A * 1/1969 Goldman ..... B65D 5/48038 108/161
3,604,556 A * 9/1971 Schwartz ..... B65D 85/00 206/387.1

(Continued)

OTHER PUBLICATIONS

Nail Polish Folder—Champagne Croc; www.roobeauty.com/nail-polish-folder-in-champagne-croc.html; 6 pages; printed on Dec. 21, 2015.

*Primary Examiner* — Anthony Stashick
*Assistant Examiner* — James Way
(74) *Attorney, Agent, or Firm* — Fredrikson & Byron, P.A.

(57) ABSTRACT

A universal nail polish storage and display assembly includes a case having a base and a cover interconnected thereto, the cover having a display frame formed therethrough. A storage unit comprising a storage medium at least partially formed of a resilient material is mounted in the case. The storage medium includes a plurality of storage compartments each dimensioned to receive a different one of a plurality of nail polish containers therein. Each storage compartment has at least one slot disposed in communication therewith such that a portion of a nail polish container which may not fit into the storage compartment itself may be at least partially inserted into the slot such that the remainder of the container fits into the storage compartment. The assembly may be utilized to store and display a plurality of different nail polish containers in an upright operative orientation.

17 Claims, 20 Drawing Sheets

(56) References Cited

U.S. PATENT DOCUMENTS

| | | | | | |
|---|---|---|---|---|---|
| 4,503,972 | A * | 3/1985 | Nelligan | B25H 3/003 | 206/369 |
| 5,024,328 | A | 6/1991 | Bontrager | | |
| 5,148,920 | A | 9/1992 | Walker | | |
| 5,320,223 | A * | 6/1994 | Allen | B25H 3/06 | 206/372 |
| 5,813,415 | A * | 9/1998 | Slali | A45D 31/00 | 132/285 |
| 6,779,665 | B2 * | 8/2004 | Bolanos | A61B 10/0096 | 206/459.5 |
| 9,465,587 | B2 * | 10/2016 | Pasternak | G06F 8/30 | |
| 2006/0180496 | A1 * | 8/2006 | Miner | A45D 29/20 | 206/581 |
| 2008/0277312 | A1 * | 11/2008 | Eren | B65D 5/509 | 206/701 |
| 2009/0178950 | A1 * | 7/2009 | Quartarone | A63B 53/00 | 206/579 |
| 2013/0118922 | A1 * | 5/2013 | McClaughry | B65B 5/08 | 206/3 |

* cited by examiner

UNIVERSAL NAIL POLISH STORAGE AND DISPLAY ASSEMBLY

BACKGROUND OF THE INVENTION

Field of the Invention

The present invention is directed to a universal storage and display assembly for nail polish. More in particular, the present invention comprises a universal storage and display assembly which securely yet replacably supports a plurality of bottles of nail polish in an upright orientation such that a user can easily view the contents of each bottle, and further, the present universal storage and display assembly securely yet replacably supports a plurality of different bottle shapes and sizes.

Description of the Related Art

Many people currently store nail polish in a basket or bin in such a way that the bottles are randomly stored with other cosmetics. This makes access to a specific nail polish product difficult. In addition, the shelf life and viscosity of the nail polish lacquer is decreased when a nail polish bottle is not stored upright. As some users have numerous different bottles of nail polish in different colors, brands, and styles of nail polish on hand at any given time, the investment in these products can be significant, such that any reduction in shelf life can result in a substantial economic impact over time.

To address the shelf life problem, some people have taken to storing nail polish bottles upright in a drawer, however, this still makes it difficult to access a specific nail polish product as a user cannot see the color of the polish as the user is looking "top down" on to the bottles in a drawer, seeing mostly the cap of the nail polish bottle.

Alternative solutions for storing bottles of nail polish include installing shelves or racks where bottles can be lined up across the wall. This is popular in many nail salons, and some have installed these in their homes as well. Others use a hanging jewelry organizer and place bottles in separate pouches. However, as is apparent, neither of these provide for storage in an efficient, compact, and/or portable manner.

Others have disclosed storage cases for nail polish, but the cases do not allow a user to see the nail polish bottles when they are stored in the case. The most prevalent type of case on the market only allows for a "top-down" view of the bottles when the case is opened, once again, making it difficult to see the type of lacquer in each nail polish bottle.

One storage case on the market is made of hard semi-opaque plastic material which allows a user to at least partially see the lacquer in the nail polish bottles. However, although claiming to be "one size fits all", because it is made of hard plastic, the bottles can jostle around and could potentially be damaged while stored or transported therein.

As such, it would be highly beneficial to provide a product which allows a user to securely yet replacably store a number of nail polish containers in an upright orientation in order to maximize the shelf life of the nail polish lacquer therein. It would also be helpful to provide a product which allows for replaceable yet secure storage of a plurality of nail polish containers having various shapes and sizes. A further benefit may be realized by providing a product which allows a user to clearly view the contents of each of a plurality of nail polish containers while securely stored therein. It would also be desirable to provide a product for portable yet secure storage of a plurality of nail polish containers which a user may carry, for example, while traveling, in such a manner that the user can clearly view the contents of each of the plurality of nail polish containers, at least while the product is in an open orientation.

SUMMARY OF THE INVENTION

The present invention is directed to a universal nail polish storage and display assembly for a plurality of nail polish containers. More in particular, a universal nail polish storage and display assembly in accordance with at least one embodiment of the present invention is structured to retain a plurality of nail polish containers having a wide variety of shapes and sizes in an upright operative orientation, so as to maximize the shelf life of the nail polish lacquer and to allow a user to readily view the contents of the various nail polish containers.

The assembly comprises a case having a base with a cover operatively interconnected thereto, wherein the cover is disposable between an open position and a closed position. In at least one embodiment, the cover includes a display frame which allows a user to view the contents of the case while the cover is disposed in the closed position.

A storage unit is mounted in the base and comprises a storage medium having a resilient material of construction. In at least one embodiment, the storage medium comprises an open cell foam material of construction. Further, the storage medium comprises a plurality of storage compartments, wherein each of the storage compartments is dimensioned and configured to receive a different one of the plurality of nail polish containers in an operative orientation therein. In at least one embodiment, the storage compartments are structured and dimensioned to retain a different one of the plurality of nail polish containers in an upright operative orientation therein, when the case is disposed in an upright display orientation.

While primarily presented with respect to the storage and display of a plurality of nail polish containers having different shapes and sizes, it will be appreciated that it is within the scope and intent of the present invention to be utilized for the storage and/or display of any of a variety of other products which come in containers having different shapes and sizes.

Furthermore, in at least one embodiment of the present invention, each of the plurality of storage compartments comprising a slot disposed in communication therewith, each slot dimensioned to receive at least a portion of a corresponding one of the plurality of nail polish containers therein. As such, if a nail polish container is dimensioned and configured such that it does not fit entirely within a storage compartment, a portion of the nail polish container may be inserted into the slot, thus allowing the remainder of the container to be received within the storage compartment. In at least one embodiment, a plurality of slots are disposed in communication with a storage compartment, such as, by way of example only, an upper slot and a lower slot.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION

Figure 1:
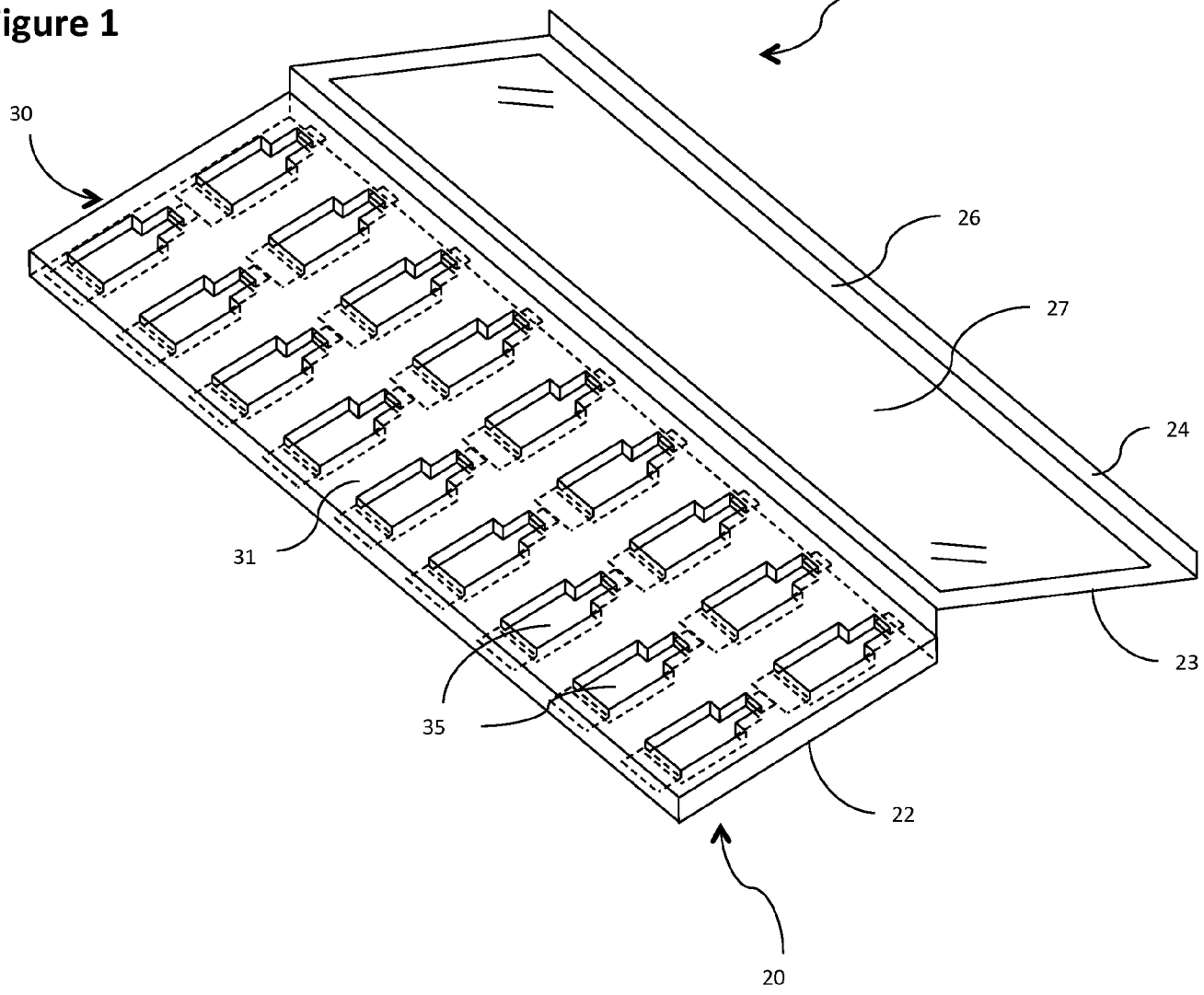
FIG. 1 is a perspective view of one illustrative embodiment of a universal nail polish storage and display assembly in accordance with the present invention in an open orientation.

As previously disclosed, the present invention is directed to a universal nail polish storage and display assembly, generally as shown as at 10 throughout the figures. FIG. 1 is illustrative of one embodiment of a universal nail polish storage and display assembly 10 in accordance with the present invention. As may be seen from FIG. 1, the assembly 10 includes a case 20 having a base 22 with a cover 23 interconnected thereto. The cover 23 is disposable between an open position, such as is shown in the illustrative embodiment of FIG. 1, and a closed position, such as is shown in the illustrative embodiment of FIG. 2.

Figure 2:
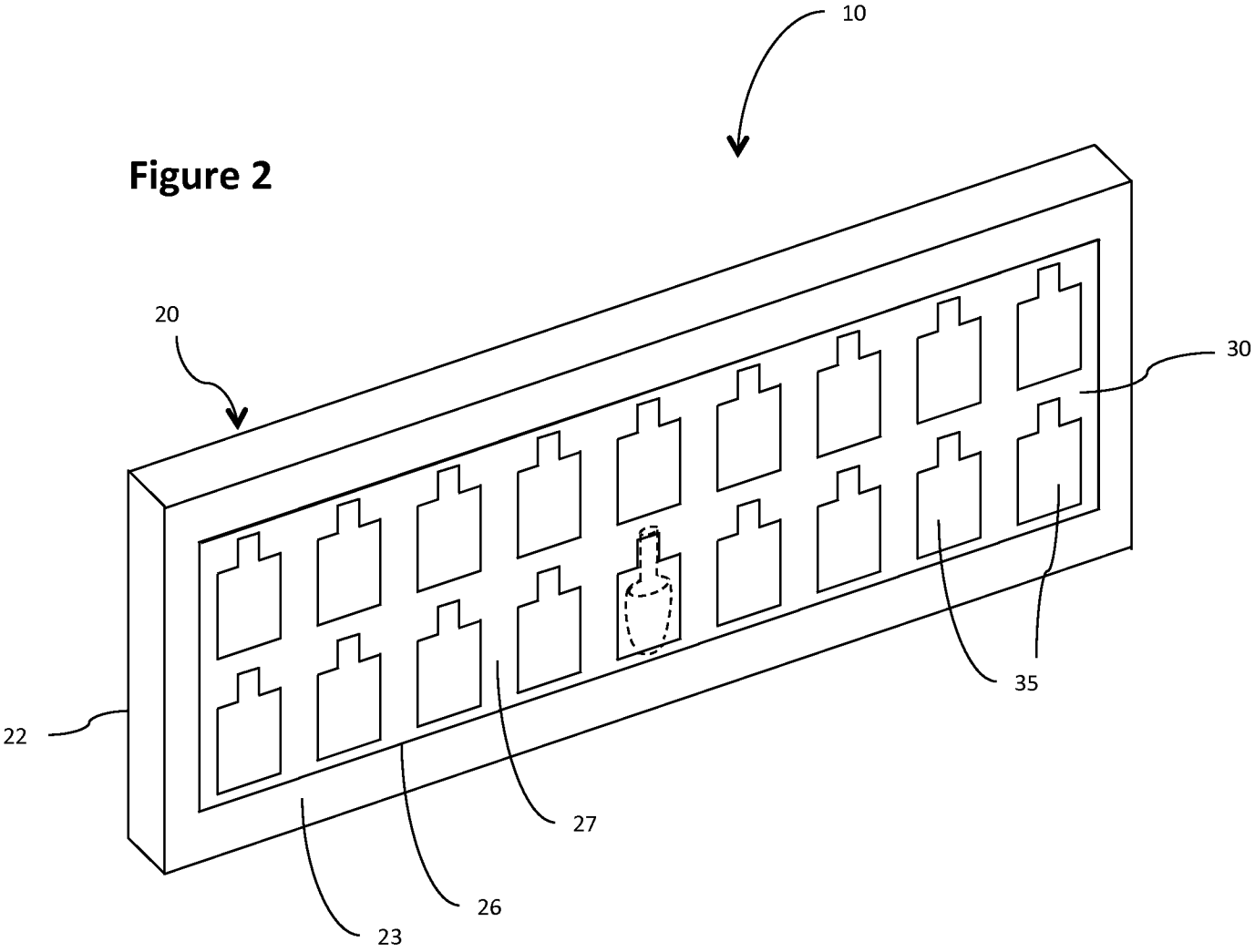
FIG. 2 is a perspective view of the universal nail polish storage and display assembly of FIG. 1 in a closed display orientation.

As may be seen from FIG. 1, in at least one embodiment, the cover 23 comprises a closure mechanism 24, in order to at least temporarily maintain the cover 23 in a closed position, once again, such as is shown in FIG. 2. It will be understood and appreciated that the closure mechanism 24 may comprise any of a plurality of mechanical fasteners such as a snaps, zippers, hook and loop fasteners, etc. In at least one embodiment, the closure mechanism 24 comprises magnetic members attached to a portion of the cover 23 and a portion of the base 22, which serves to temporarily maintain cover 23 in a closed position.

Figure 13:
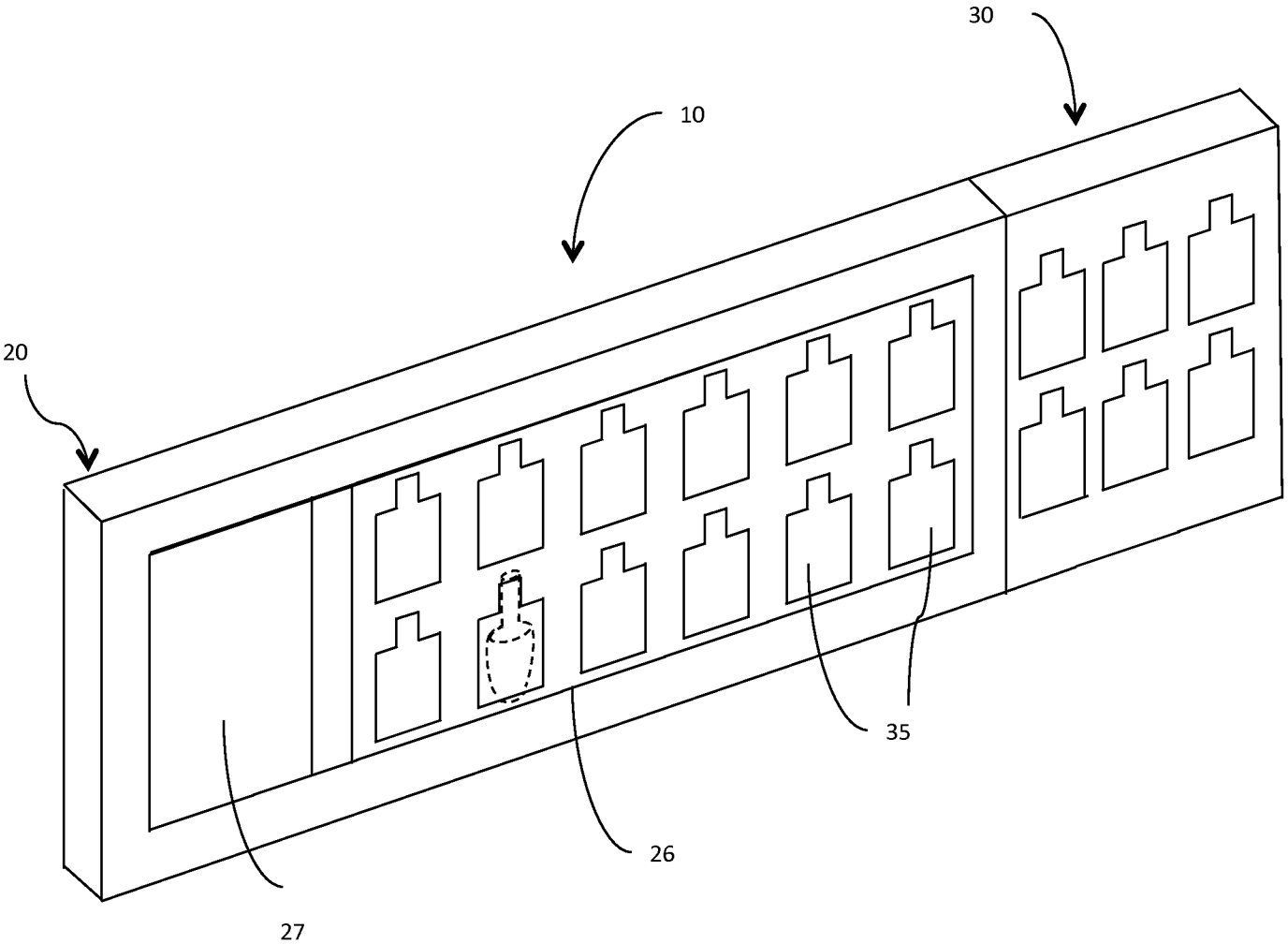
FIG. 13 is a perspective view of one further alternate illustrative embodiment of a universal nail polish storage and display assembly in accordance with the present invention.

In at least one embodiment, the cover 23 includes a display frame 26 which is dimensioned to permit each of a plurality of nail polish containers which are disposed in an upright operative orientation in corresponding storage compartments 35 of a storage unit 30, discussed in more detail below, to be readily viewable by a user while the cover 23 is in a closed position, once again, as shown best in the illustrative embodiment of FIG. 2. FIG. 13 is illustrative of one further alternative embodiment of a case 20 having a display frame 26 with a display window 27 mounted therein, and wherein the case 20 is dimensioned configured to slidingly receive a storage unit 30 through one end thereof, as shown.

As further shown in the illustrative embodiment of FIG. 1, a universal nail polish storage and display assembly 10 in accordance with the present invention includes a storage unit 30. In at least one embodiment, the storage unit 30 is mounted in the base 22 of the case 20, such as is shown in FIG. 1. The storage unit 30 comprises a storage medium 31 which, in at least one embodiment, comprises a resilient material of construction. As one example, the storage medium 31 in accordance with at least one embodiment of the present invention is at least partially constructed of a foam material including but not limited to a polyurethane foam, an open cell polyurethane foam, polyester foam, an open cell polyester foam, a polyether foam, an open cell polyether foam, a memory foam, an open cell memory foam, a polyethylene foam, an open cell polyethylene foam, an ethylene-vinyl acetate (EVA) foam, an open cell EVA, etc. Of course, it will be understood and appreciated by those skilled in the art that any number of resilient materials of construction may be utilized to form a storage medium 31 in accordance with the present invention.

Looking once again to the illustrative embodiment of FIG. 1, the storage medium 31 comprises a plurality of storage compartments 35 which are formed at least partially therethrough. Each of the plurality of storage compartments 35 is dimensioned and configured to receive different ones of the plurality of nail polish containers and to at least temporarily retain the corresponding one of the plurality of nail polish containers in an upright operative orientation therein, such as is illustrated best in FIG. 2. As previously stated, nail polish containers are preferably stored in an upright orientation in order to maximize the shelf life of the nail polish lacquer contained therein, therefore, in at least one embodiment, the case 20 is configured to be positioned and maintained in an upright display orientation, such as is shown best in FIG. 2.

As shown throughout the illustrative embodiments in the figures, the storage compartments 35 have similar dimensions and configurations, however, it will be appreciated by those of skill in the art that it is within the scope and intent of the present invention for the plurality of storage compartments 35 in a support medium 31 to comprise either similar or different dimensions and configurations.

Figure 2A:
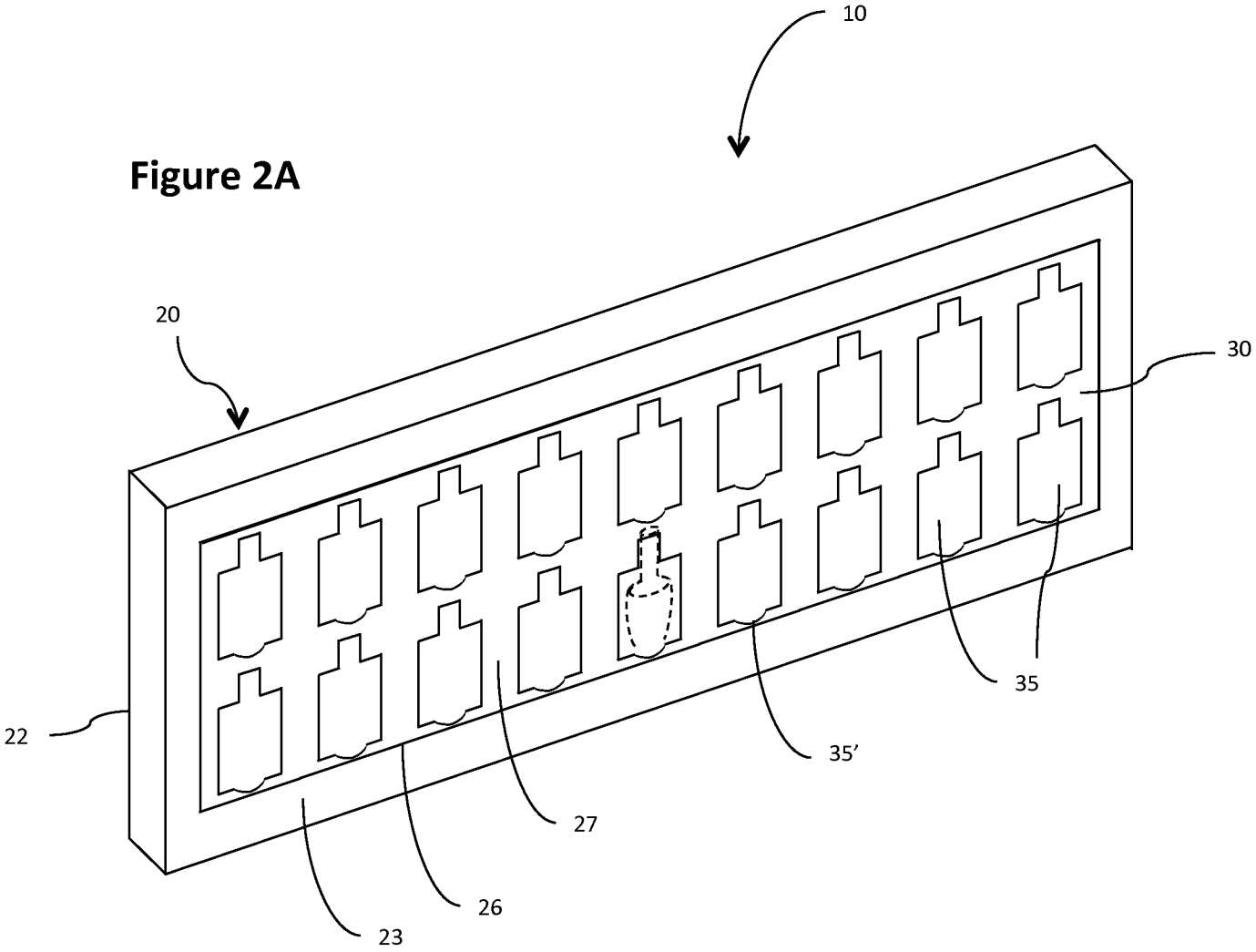
FIG. 2A is a perspective view of another illustrative embodiment of a universal nail polish storage and display assembly in accordance with the present invention.
Figure 2B:
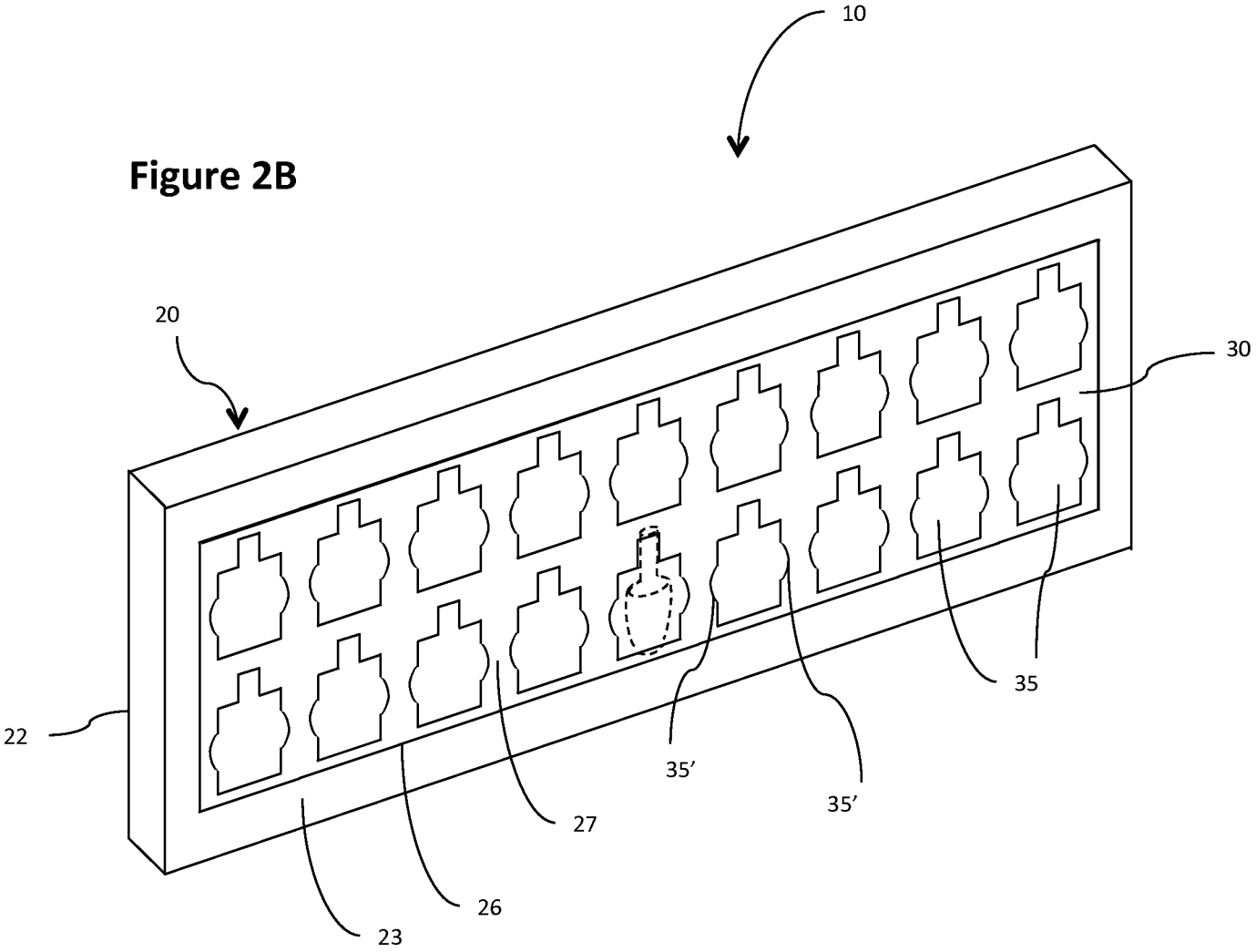
FIG. 2B is a perspective view of yet another illustrative embodiment of a universal nail polish storage and display assembly in accordance with the present invention.

As one example, and as shown in the illustrative embodiment of FIG. 2A, storage unit 30 comprises a plurality of storage compartments 35 wherein at least some of the plurality of storage compartments 35 comprise a release notch 35' along the bottom. More in particular, release notch 35' is dimensioned and positioned to facilitate insertion and/or removal of a nail polish container from a corresponding one of the plurality of storage compartments 35. FIG. 2B is illustrative of one further embodiment of a storage unit 30 having a plurality of storage compartments 35 wherein at least some of the plurality of storage compartments 35 comprise a plurality of release notches 35'. As shown in the illustrative embodiment of FIG. 2B, a corresponding pair of release notches 35' are disposed along opposite sides of each storage compartment 35. As before, the plurality of release notches 35' are dimensioned and positioned to facilitate insertion and/or removal of a nail polish container from a corresponding one of the plurality of storage compartments 35.

In at least one embodiment, and as shown in FIGS. 1 and 2, a display window 27 is mounted in display frame 26. In at least one embodiment, the display window 27 comprises a substantially transparent material of construction. As such, and again as shown best in the illustrative embodiment of FIG. 2, which illustrates the case 20 in an upright display orientation, the plurality of nail polish containers will be readily viewable through the display window 27 mounted in the display frame 26 while the plurality of nail polish containers are stored in an upright operative orientation within a universal nail polish container storage and display assembly 10 in accordance with the present invention.

In at least one further embodiment, a display window 27 in accordance with the present invention comprises an ultraviolet resistant material of construction so as to minimize the amount of ultraviolet radiation to which the nail polish lacquers contained within the nail polish containers stored within the assembly 10 are exposed. By minimizing exposure to ultraviolet radiation, the shelf life of the nail polish lacquer within nail polish containers can be extended which, as previously indicated, can provide significant economic benefits over time.

Figure 3:
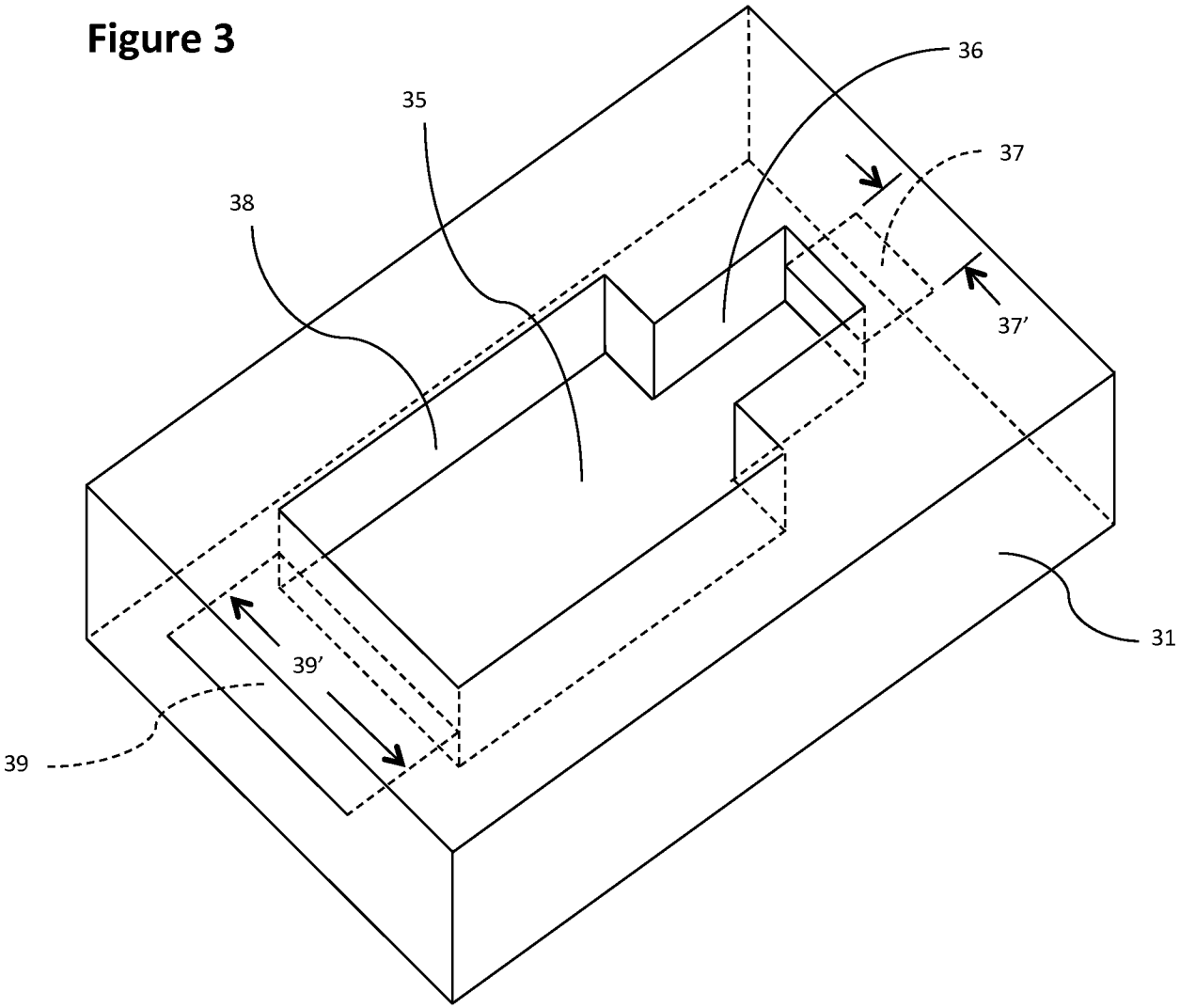
FIG. 3 is a perspective view of one illustrative embodiment of a portion of a storage unit in accordance with the present invention.

Turning next to FIG. 3, an illustrative embodiment of a portion of storage medium 31 including a storage compartment 35 is presented. As may be seen from FIG. 3, storage compartment 35 includes an upper portion 36 and a lower portion 38. As noted above, each storage compartment 35 is dimensioned and configured to receive at least one of a plurality of different nail polish containers therein. As such, the upper portion 36 of storage compartment 35 is generally dimensioned and configured to receive a neck and cap of a nail polish container, while lower portion 38 of storage compartment 35 is generally dimensioned and configured to receive the bottle portion of a nail polish container.

It is well known that nail polish containers come in a wide variety of shapes and sizes, and as a result, prior attempts at a "one size fits all" storage device have not been practically applied. As such, and in accordance with the present invention, each storage compartment 35 comprises at least one slot disposed in communication with a portion of the storage compartment 35. With reference once again to FIG. 3, an upper slot 37 is formed through a portion of the storage medium 31 and is disposed in communication with and along an upper edge of upper portion 36. As shown in the illustrative embodiment of FIG. 3, the upper slot 37' comprises an upper slot width 37' which is essentially equivalent to the width of the upper portion 36 of the storage compartment 35. Thus, when a user wishes to place a nail polish container into a storage compartment 35 but the container is taller than the height of the storage compartment 35, the user simply inserts the top of the nail polish container into upper slot 37 until the bottle portion of the container fits into lower portion 38 of the storage compartment 35.

Of course, some nail polish containers may not fit into the storage compartment 35 even when the top of the container is inserted into the upper slot 37. As such, FIG. 3 illustrates an embodiment of a storage compartment 35 further comprising a lower slot 39. As shown in FIG. 3, the lower slot 39 is also formed through a portion of the storage medium 31 and is disposed in communication with and along a lower edge of the lower portion 38 of storage compartment 35. Lower slot 39 comprises a lower slot width 39' which is essentially equivalent to the width of the lower portion 38 of storage compartment 35, as shown best in the embodiment of FIG. 3. Thus, when a user wishes to place a nail polish container into storage compartment 35, and the container is too tall even after inserting the top into upper slot 37, the bottom portion of the container maybe inserted into lower slot 39, such as is shown by way of example in FIG. 2.

Figure 4:
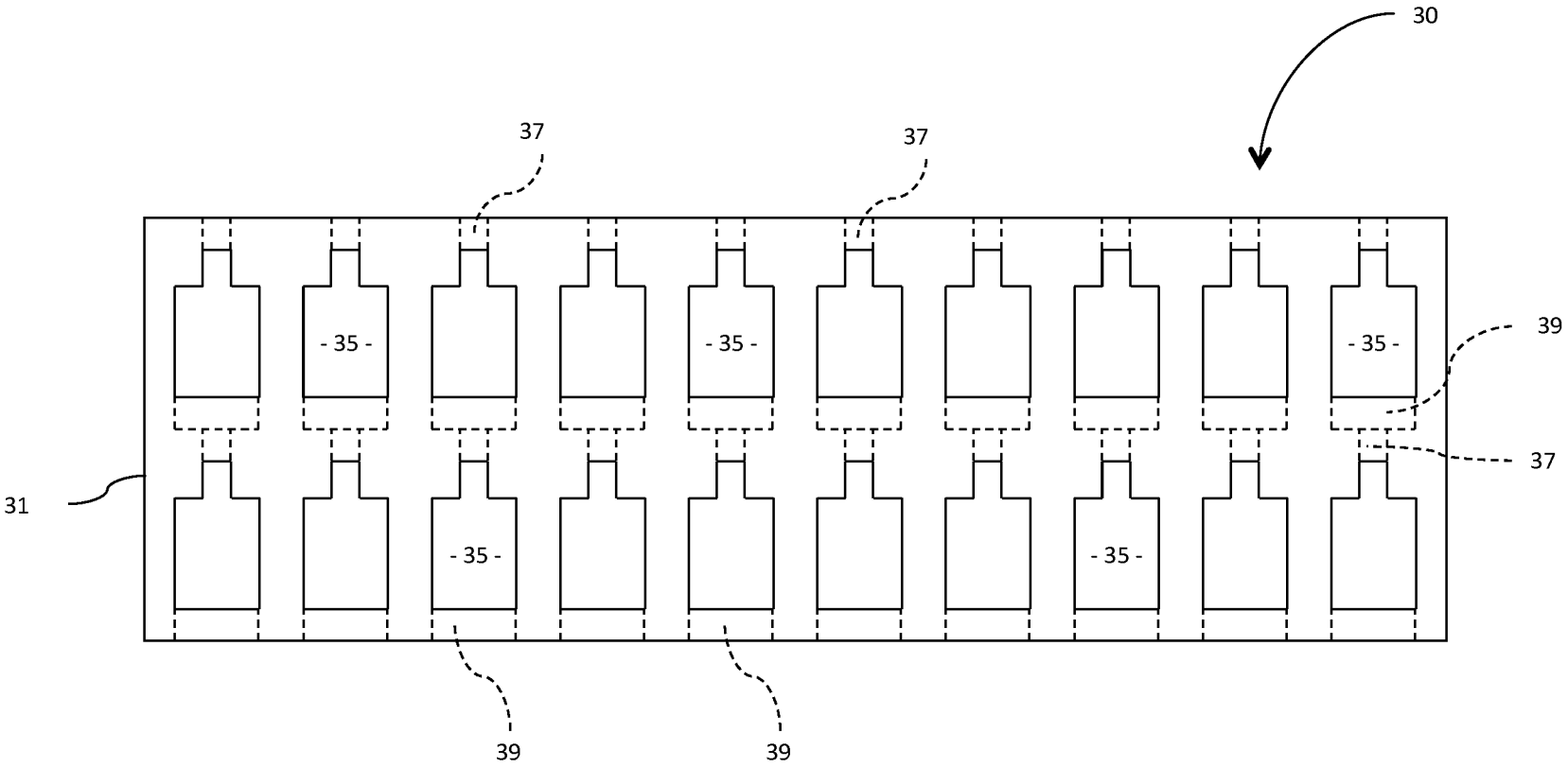
FIG. 4 is a plan view of one illustrative embodiment of a storage unit in accordance with the present invention.

FIG. 4 is illustrative of one embodiment of a storage unit 30 of the present invention. As before, storage unit 30 comprises a storage medium 31 which is constructed of a resilient material. Further, as is shown in the illustrative embodiment of FIG. 4, the storage medium 31 comprises a plurality of storage compartments 35 formed at least partially therethrough. In at least one embodiment, the storage compartments 35 are only formed partially through the storage medium 31, thereby leaving a layer of resilient material in a supporting relation to the backside of the nail polish container being stored therein. In at least one further embodiment, a plurality of storage compartments 35 are formed completely through storage medium 31 such as by cutting, die cutting, water jet cutting, punching, etc. In such an embodiment, a storage unit 30 may employ a backing member {not shown} which is mounted along one side of storage medium 31 thereby providing a supporting surface for the backside of a nail polish container which is received within one of the plurality of storage compartments 35 of storage unit 30. As shown in the illustrative embodiment of FIG. 4, each of the plurality of storage compartments 35 comprises an upper slot 37 and a lower slot 39, such as described above with reference to FIG. 3. Once again, however, it is noted that a storage compartment 35 in accordance with the present invention may comprise a single slot, such as, one of an upper slot 37, or a lower slot 39.

Figure 5:
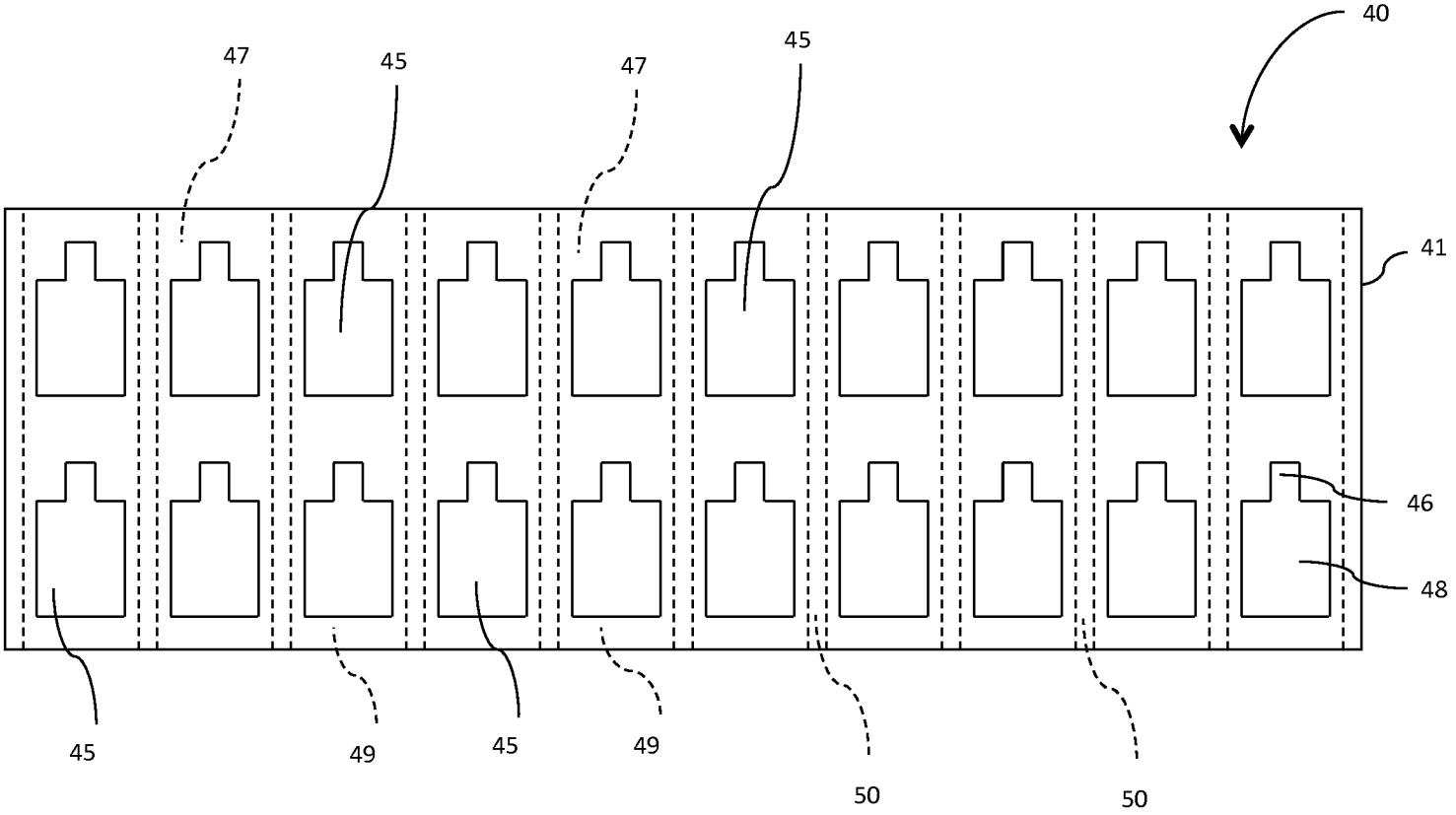
FIG. 5 is a plan view of another illustrative embodiment of a composite storage unit in accordance with the present invention.
Figure 6:
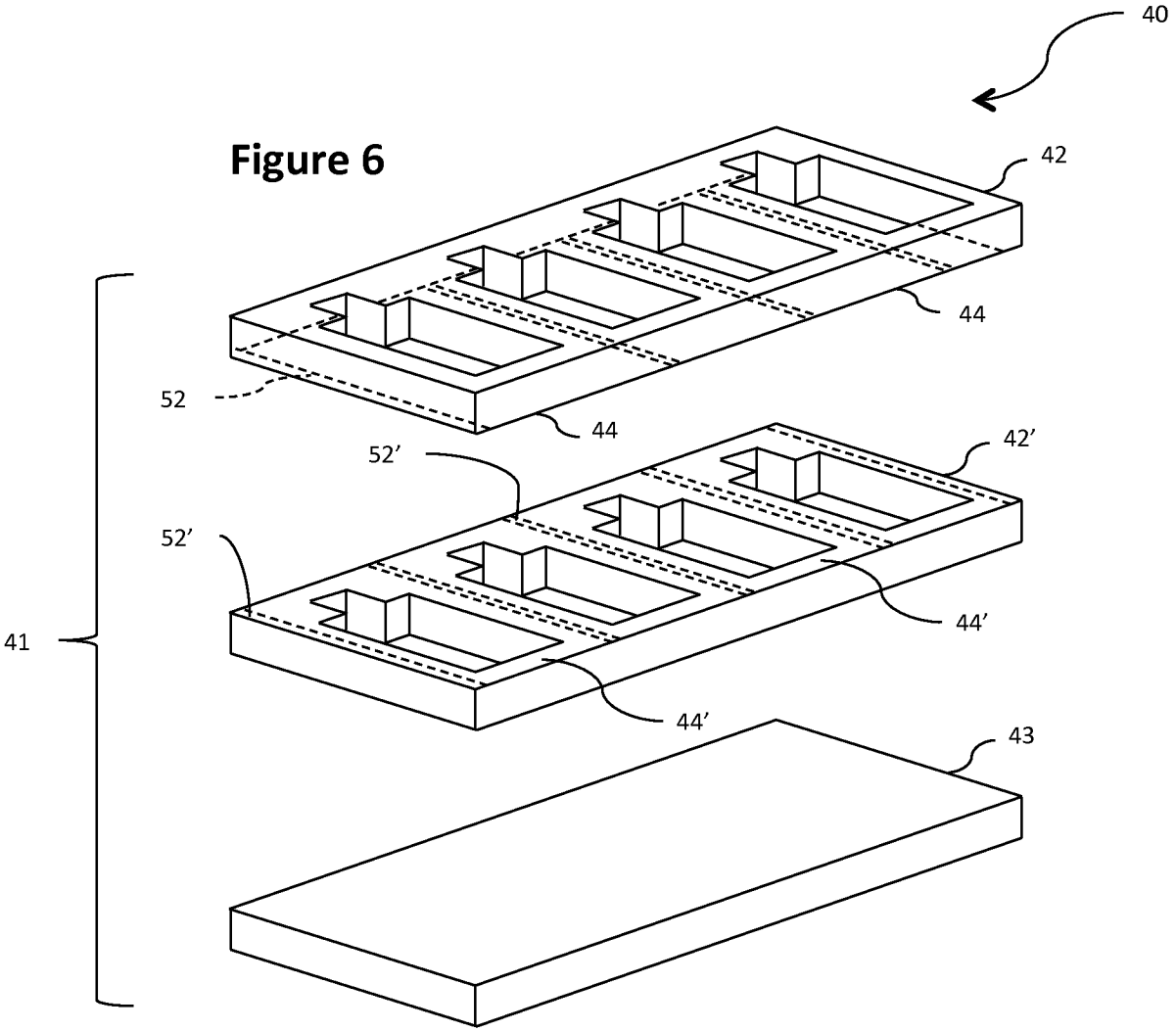
FIG. 6 is an exploded partial perspective view of the composite storage unit of FIG. 5.

FIGS. 5 and 6 present one illustrative embodiment of a composite storage unit 40 in accordance with the present invention. As with storage unit 30 disclosed above, composite storage unit 40 comprises a storage medium 41 which is, once again, at least partially constructed of a resilient material of construction. As may be seen from FIG. 5, storage medium 41 comprises a plurality of storage compartments 45 formed therein which, similar to storage compartments 35, are each dimensioned and configured to receive a different one of each of a plurality of nail polish containers therein. As such, and as before, each storage compartment 45 comprises an upper portion 46 and a lower portion 48, as is shown in the illustrative embodiment of FIG. 5.

Turning next to FIG. 6, an exploded view of a portion of a composite storage unit 40 is presented. As shown in the illustrative embodiment of FIG. 6, storage medium 41 comprises a first member 42, a second member 42', and a backing member 43, wherein at least first member 42 and second member 42' comprise a resilient material construction. In at least one embodiment, each of a first member 42, a second member 42', and a backing member 43 of a storage medium 41 comprise resilient materials of construction.

FIG. 5 illustrates a plurality of member interconnects 50 disposed between corresponding storage compartments 45. In at least one embodiment, each of a plurality of member interconnects 50 comprise a first interconnect 52 and a second interconnect 52'. As just one example, and as shown best in FIG. 6, each member interconnect 50 comprises a first interconnect 52 disposed on a first surface 44 of first member 42 and corresponding second interconnect 52' disposed on a second surface 44' of second member 42'. As will be appreciated from the exploded view presented in FIG. 6, corresponding ones of first interconnects 52 and second interconnects 52' are cooperatively positioned and disposed to facilitate attachment of first member 42 to second member 42'. The member interconnects 50 may be achieved in at least one embodiment via adhesive to bond the first member 42 to the second member 42'. Of course, it will be understood and appreciated by those of skill in the art that other member interconnects 50 may be employed in accordance with the present invention including, by way of example only, heat welding, sonic welding, tape, sewing, hook and loop type fasteners, tongue and grove interconnections, etc.

As will be appreciated from the illustrative embodiments in FIGS. 5 and 6, as first member 42 and second member 42' are only attached to one another along the member interconnects 50, the first surface 44 and second surface 44' are disposed adjacent one another but remain detached from one another, thereby forming upper slot 47 and lower slot 49 therebetween. As shown best in FIG. 5, each upper slot 47 and lower slot 49 of storage medium 41 are bounded by corresponding pairs of member interconnects 50.

Figure 14:
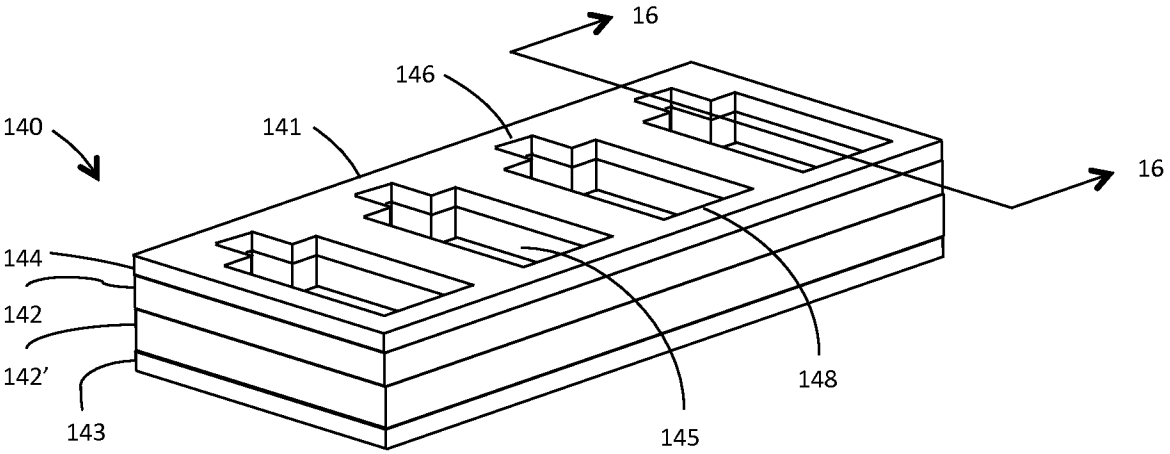
FIG. 14 is a partial perspective view of still one further illustrative embodiment of a composite storage unit in accordance with the present invention.
Figure 15:
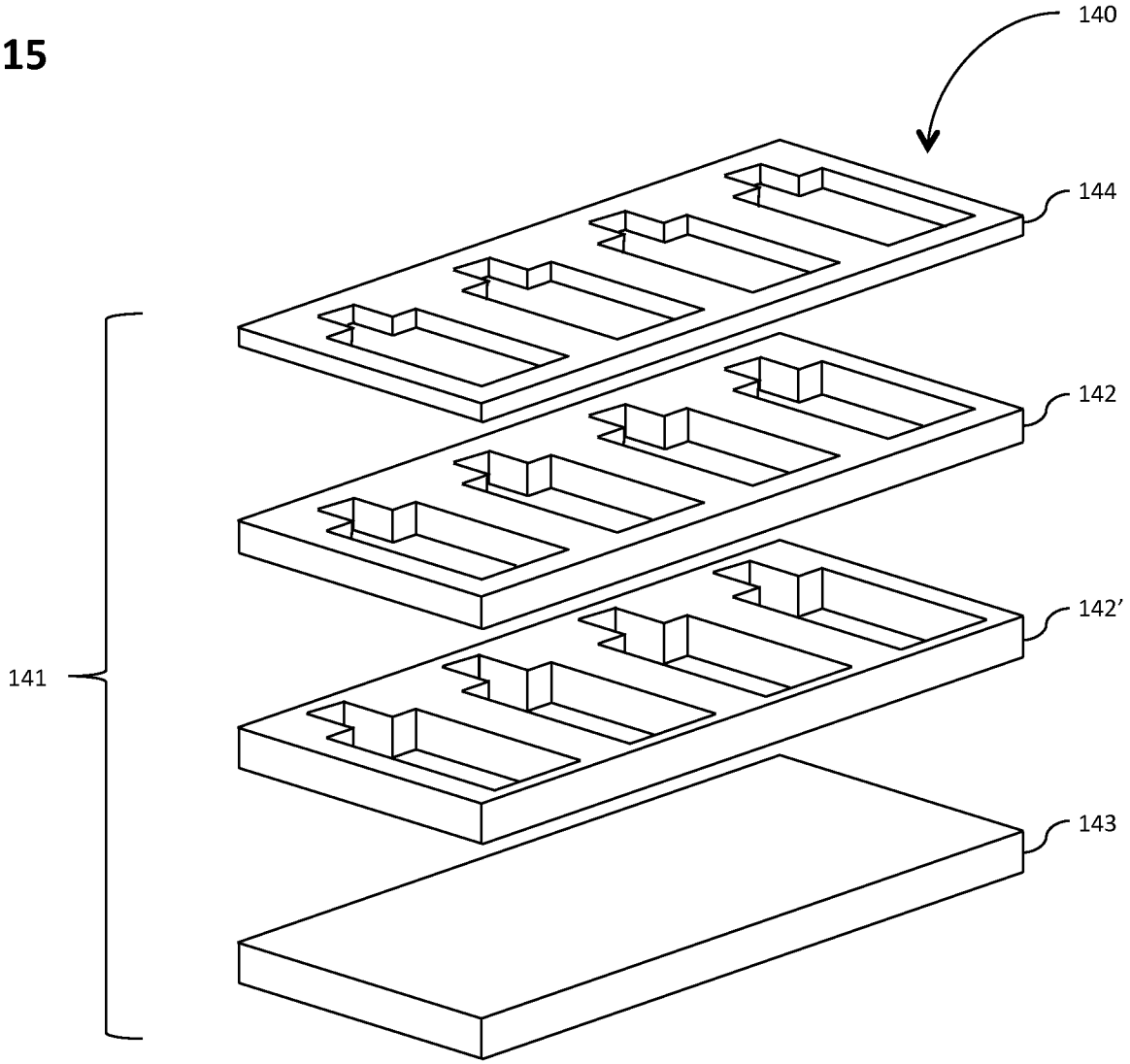
FIG. 15 is an exploded perspective view of the composite storage unit of FIG. 14.
Figure 16:
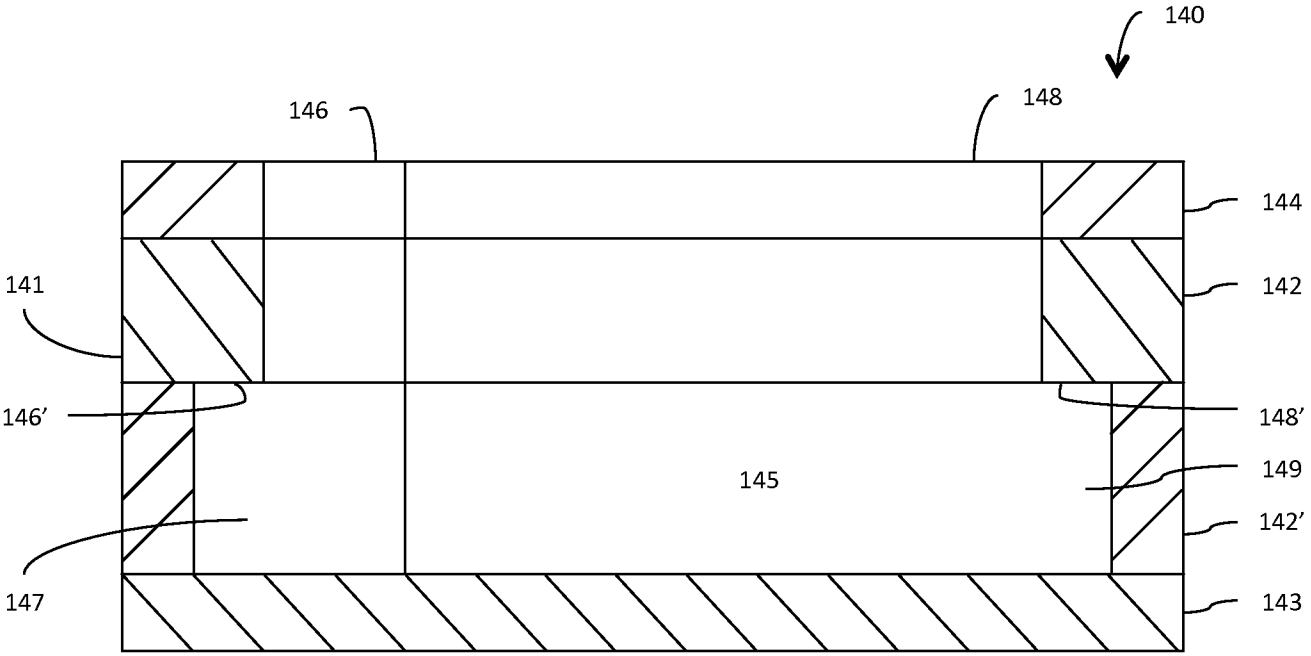
FIG. 16 is a cross-sectional view of the composite storage unit of FIG. 14 along lines 16-16 thereof.

FIGS. 14 through 16 present one illustrative alternate embodiment of a composite storage unit 140 in accordance with the present invention. As with composite storage unit 40 disclosed above, composite storage unit 140 comprises a storage medium 141 which is, once again, at least partially constructed of a resilient material of construction. As before, the storage medium 141 in accordance with at least one embodiment of the present invention is at least partially constructed of a foam material including but not limited to a polyurethane foam, an open cell polyurethane foam, polyester foam, an open cell polyester foam, a polyether foam, an open cell polyether foam, a memory foam, an open cell memory foam, a polyethylene foam, an open cell polyethylene foam, an ethylene-vinyl acetate (EVA) foam, an open cell EVA, etc. Of course, it will be understood and appreciated by those skilled in the art that any number of resilient materials of construction may be utilized to form a storage medium 411 in accordance with the present invention.

As may be seen from FIG. 14, storage medium 141 comprises a plurality of storage compartments 145 formed therein which, similar to storage compartments 45, are each dimensioned and configured to receive a different one of each of a plurality of nail polish containers therein. As such, and as before, each storage compartment 145 comprises an upper portion 146 and a lower portion 148, as is shown best in the illustrative embodiment of FIG. 14.

Turning next to FIG. 15, an exploded view of a portion of a composite storage unit 140 is presented. As shown in the illustrative embodiment of FIG. 15, storage medium 141 comprises a first member 142, a second member 142', a backing member 143, and a cover member 144. In at least one embodiment, one of both of first member 142 and/or second member 142' comprise a resilient material construction. In at least one embodiment, one or more of each of a first member 142, a second member 142', a backing member 143, and a cover member 144 of a storage medium 141 comprise resilient materials of construction. In at least one embodiment, each of a first member 142 and a second member 142' are constructed of an open cell polyurethane foam, while the backing member 143 and cover member 144 are constructed of an ethylene-vinyl acetate (EVA) foam.

As before, each of a first member 142, a second member 142', a backing member 143, and a cover member 144 of a storage medium 141 are attached to one another to form a composite storage unit 140 in accordance with the present invention by any of a variety of means including, by way of example only, adhesives, heat welding, sonic welding, tape, sewing, hook and loop type fasteners, tongue and grove interconnections, etc.

As will be appreciated from the illustrative embodiment in FIG. 16, the upper portion 146' of the second member 142' extends beyond the upper portion 146 of the first member 142 and the cover member 144, and as a result, an upper slot 147 is formed in the upper portion 146' of the second member 142', as shown best in FIG. 16. Similarly, the lower portion 148' of the second member 142' extends beyond the lower portion 148 of the first member 142 and the cover member 144, thereby resulting in a lower slot 149 being formed in the lower portion 148' of the second member 142', once again, as shown best in FIG. 16.

Thus, when a nail polish container having a cap which is longer than the upper portion 146 of the first member 142 and the cover member 144, a portion of the cap is positioned under the first member 142 and into the upper slot 147. Likewise, when a nail polish container has a bottle or base which is longer than the lower portion 148 of the first member 142 and cover member 144, a portion of the bottle or base is positioned under the first member 142 and into the lower slot 149. As such, a composite storage unit 140 in accordance with the present invention temporarily yet securely supports a plurality of different nail polish bottle shapes and sizes.

Figure 17:
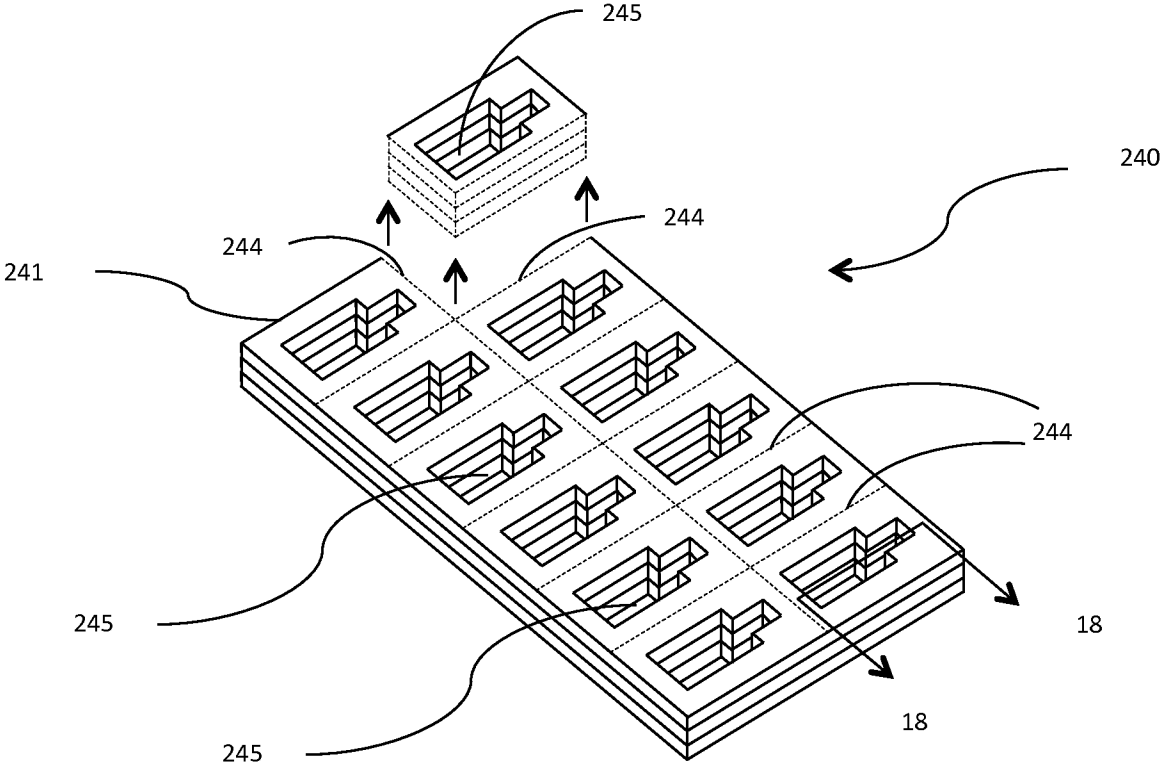
FIG. 17 is a partial perspective view of yet one further illustrative embodiment of a composite storage unit in accordance with the present invention.
Figure 18:
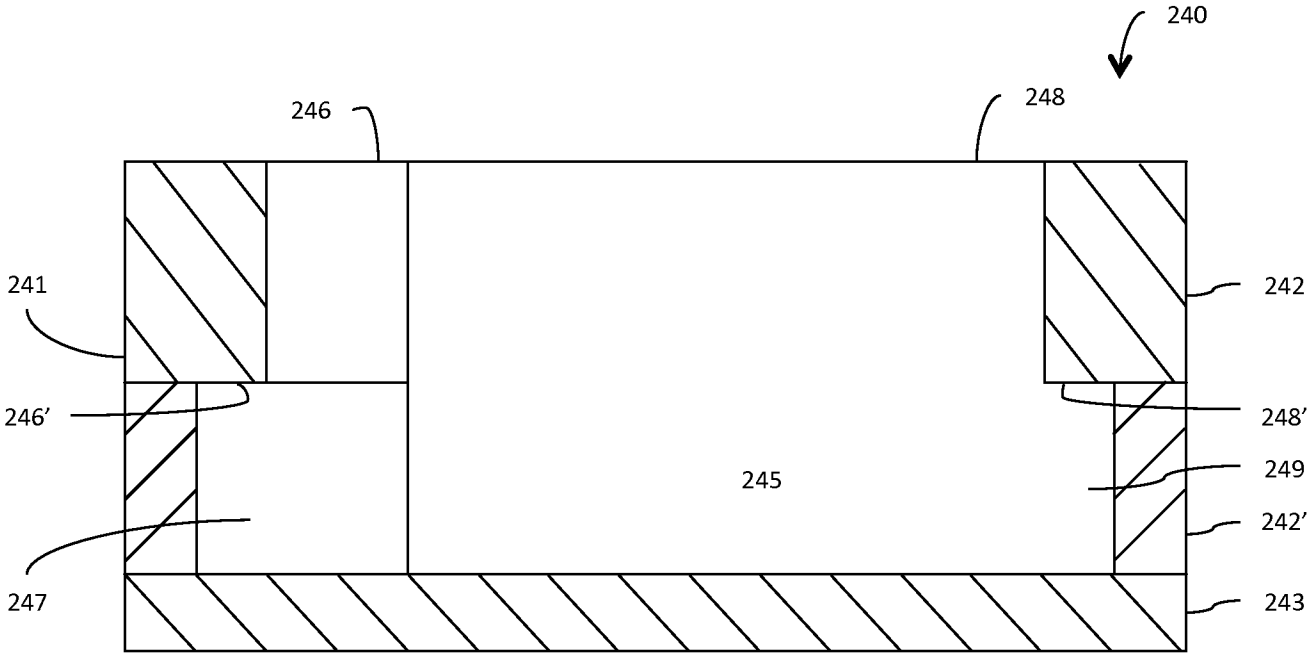
FIG. 18 is a cross-sectional view of the composite storage unit of FIG. 17 along lines 18-18 thereof.

FIGS. 17 and 18 are illustrative of yet one further alternate embodiment of a composite storage unit 240 in accordance with the present invention. As with composite storage units 40, 140 disclosed above, composite storage unit 240 comprises a storage medium 241 which is, once again, at least partially constructed of a resilient material of construction. As before, the storage medium 241 in accordance with at least one embodiment of the present invention is at least partially constructed of a foam material including but not limited to a polyurethane foam, an open cell polyurethane foam, polyester foam, an open cell polyester foam, a polyether foam, an open cell polyether foam, a memory foam, an open cell memory foam, a polyethylene foam, an open cell polyethylene foam, an ethylene-vinyl acetate (EVA) foam, an open cell EVA, etc. Of course, it will be understood and appreciated by those skilled in the art that any number of resilient materials of construction may be utilized to form a storage medium 241 in accordance with the present invention.

As may be seen from FIG. 17, storage medium 241 comprises a plurality of storage compartments 245 formed therein which, similar to storage compartments 45, 145, are each dimensioned and configured to receive a different one of each of a plurality of nail polish containers therein. As further shown in the illustrative embodiment of FIG. 17, each of the plurality of storage compartments 245 may be individually separated from one another along a perforation or score 244 formed in storage medium 241 itself. As such, in accordance with at least one embodiment of the present invention, a plurality of individual storage compartments 245 may be obtained from a single storage medium 241, as shown by way of example in FIG. 17.

Turning next to the illustrative embodiment of FIG. 18, storage medium 241 comprises a first member 242, a second member 242', and a backing member 243. In at least one embodiment, one of both of first member 242 and/or second member 242' comprise a resilient material construction. In at least one embodiment, one or more of each of a first member 242, a second member 242', and a backing member 243 comprise resilient materials of construction. In at least one embodiment, each of a first member 242, a second member 242', and a backing member 243 are constructed of an open cell polyurethane foam.

As before, each of a first member 242, a second member 242', and a backing member 243 of a storage medium 241 are attached to one another to form a composite storage unit 240 in accordance with the present invention by any of a variety of means including, by way of example only, adhesives, heat welding, sonic welding, tape, sewing, hook and loop type fasteners, tongue and grove interconnections, etc.

As before, each storage compartment 245 comprises an upper portion 246 and a lower portion 248, as shown in FIG. 18. As will be appreciated from the illustrative embodiment of FIG. 18, the upper portion 246' of the second member 242' extends beyond the upper portion 246 of the first member 242, and as a result, an upper slot 247 is formed in the upper portion 246' of the second member 242', as shown best in FIG. 18. Similarly, the lower portion 248' of the second member 242' extends beyond the lower portion 248 of the first member 242, thereby forming a lower slot 249 in the lower portion 248' of the second member 242', once again, as shown best in FIG. 18.

Thus, once again, when a nail polish container having a cap which is longer than the upper portion 246 of the first member 242, a portion of the cap is positioned under the first member 242 and into the upper slot 247. Likewise, when a nail polish container has a bottle or base which is longer than the lower portion 248 of the first member 242, a portion of the bottle or base is positioned under the first member 242 and into the lower slot 249. As such, a composite storage unit 240 in accordance with the present invention temporarily yet securely supports a plurality of different nail polish bottle shapes and sizes.

Figure 7:
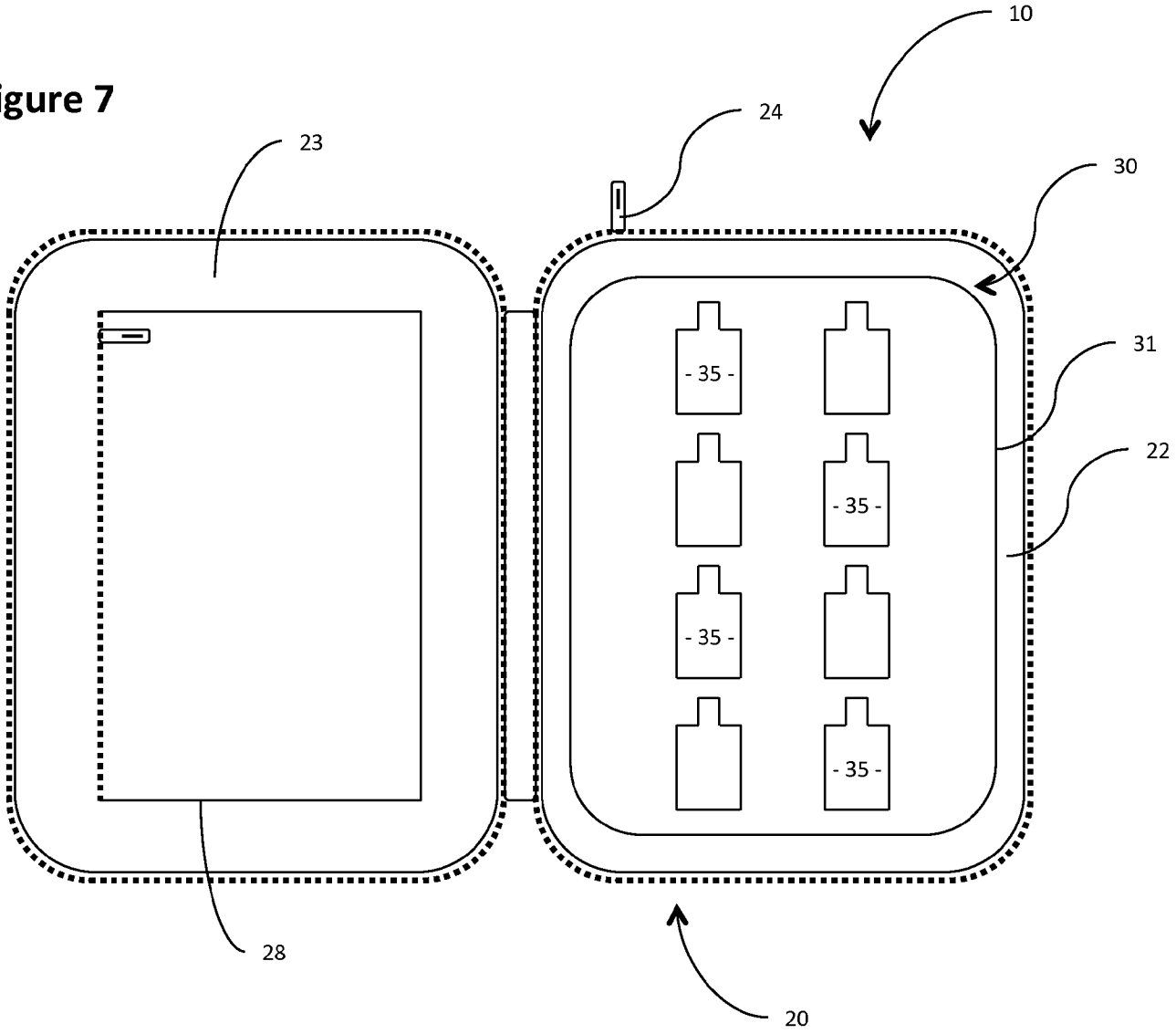
FIG. 7 is a plan view of one illustrative alternate embodiment of a universal nail polish storage and display assembly in accordance with the present invention.
Figure 8:
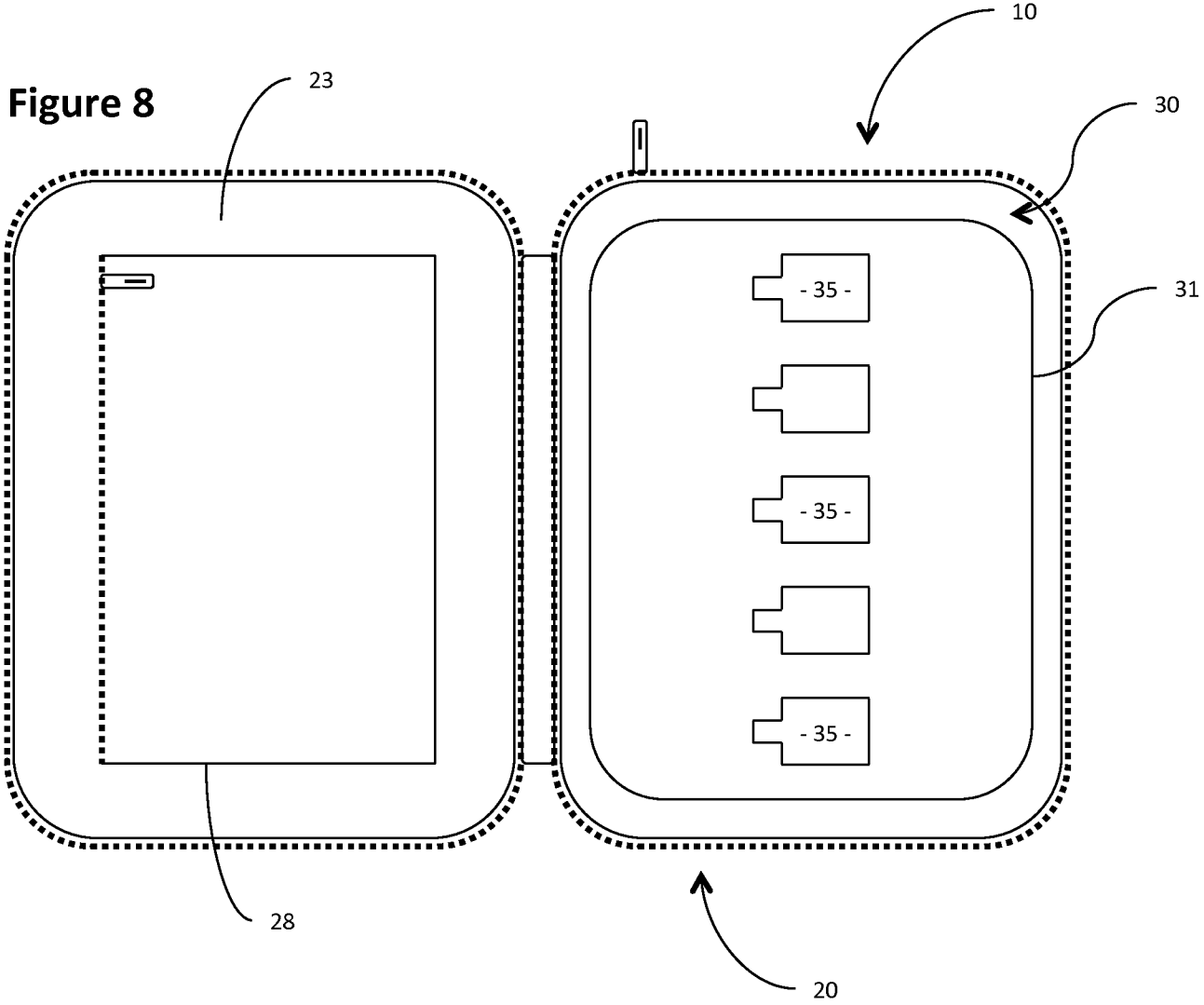
FIG. 8 is a plan view of another illustrative alternate embodiment of a universal nail polish storage and display assembly in accordance with the present invention.

FIG. 7 is illustrative of one alternate embodiment of a universal nail polish storage and display assembly 10 in accordance with the present invention. In particular, the assembly 10 comprises a case 20 having a base 22 and a cover 23 movably interconnected thereto. A closure mechanism 24, which comprises a zipper in the illustrative embodiment in FIG. 7, is utilized to retain the cover 23 in a closed position. In at least one embodiment, the cover 23 comprises a substantially transparent material of construction such that a user can view the contents of the case 20 while the cover 23 is closed. An accessory pouch 28 is attached to the cover 23 in at least one embodiment of the universal nail polish storage and display assembly 10 in accordance with the present invention, such as is shown in the illustrative embodiment of FIG. 7. The assembly 10 in accordance with FIG. 7 comprises a storage unit 30 having a storage medium 31 which is, once again, at least partially formed from a resilient material of construction. As before, storage medium 31 comprises a plurality of storage compartments 35 formed therein, and each storage compartment 35 is dimensioned and configured to at least temporarily receive and retain a different one of a plurality of nail polish containers therein.

Figure 9:
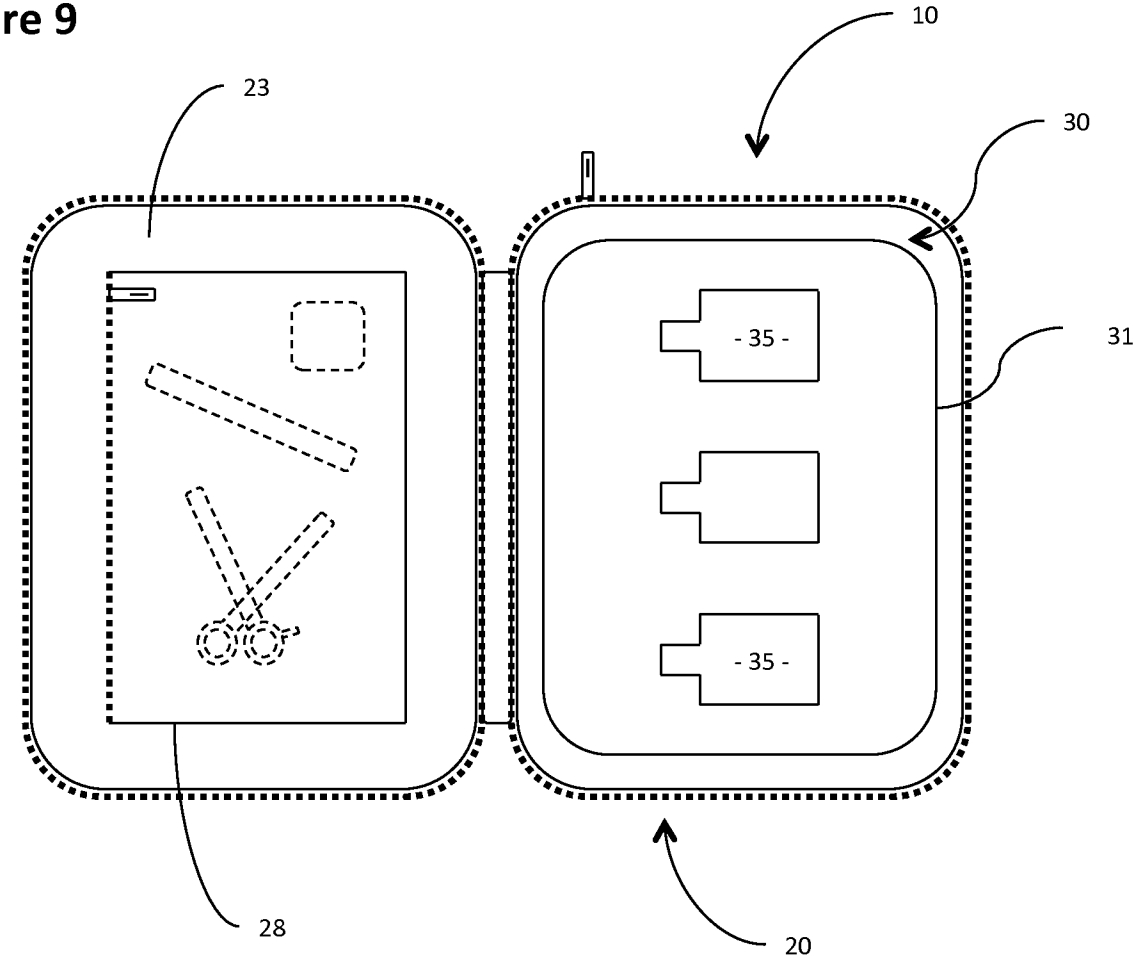
FIG. 9 is a plan view of one further illustrative alternate embodiment of a universal nail polish storage and display assembly in accordance with the present invention.
Figure 11:
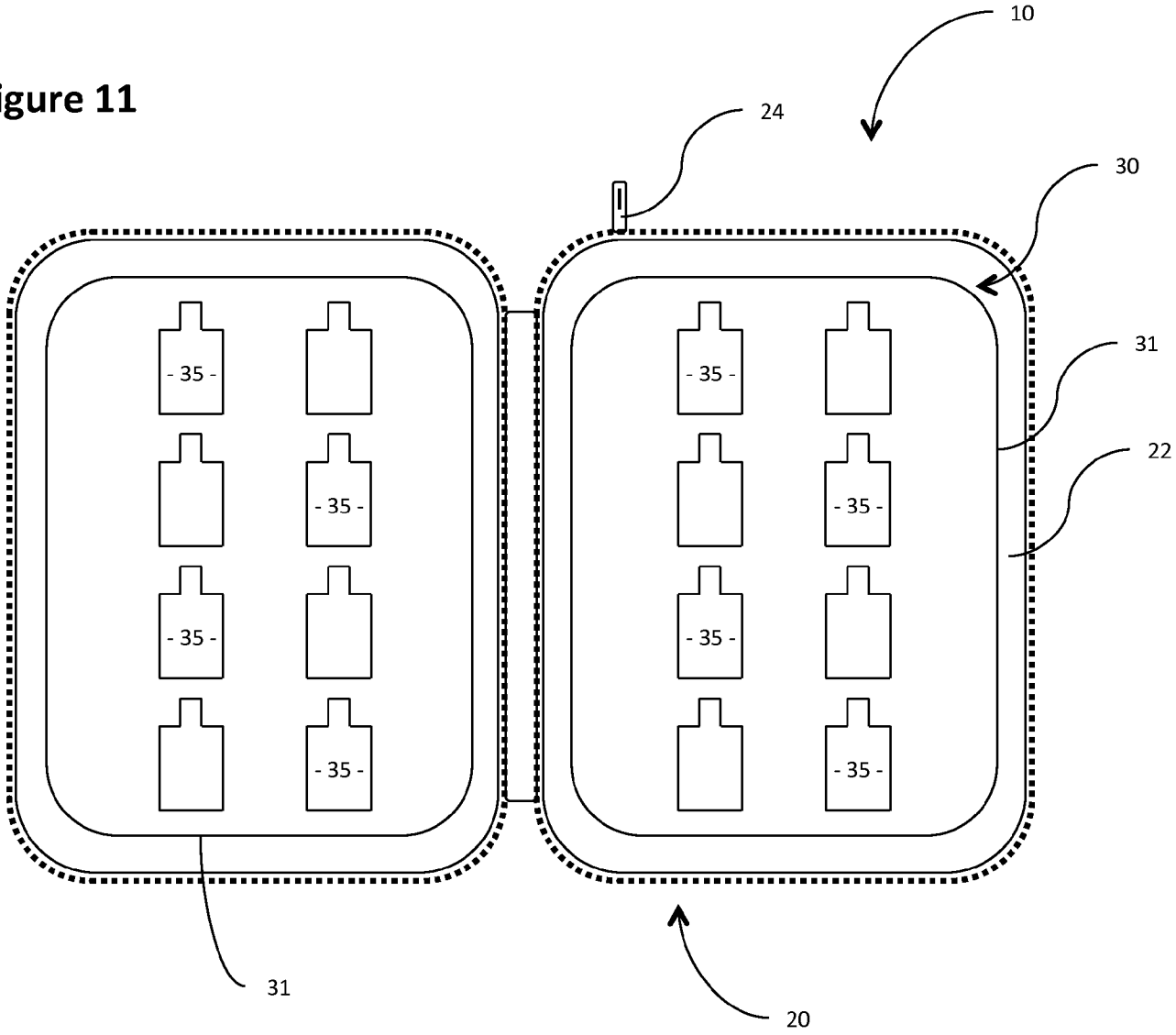
FIG. 11 is a plan view of yet one further illustrative alternate embodiment of a universal nail polish storage and display assembly in accordance with the present invention.
Figure 12:
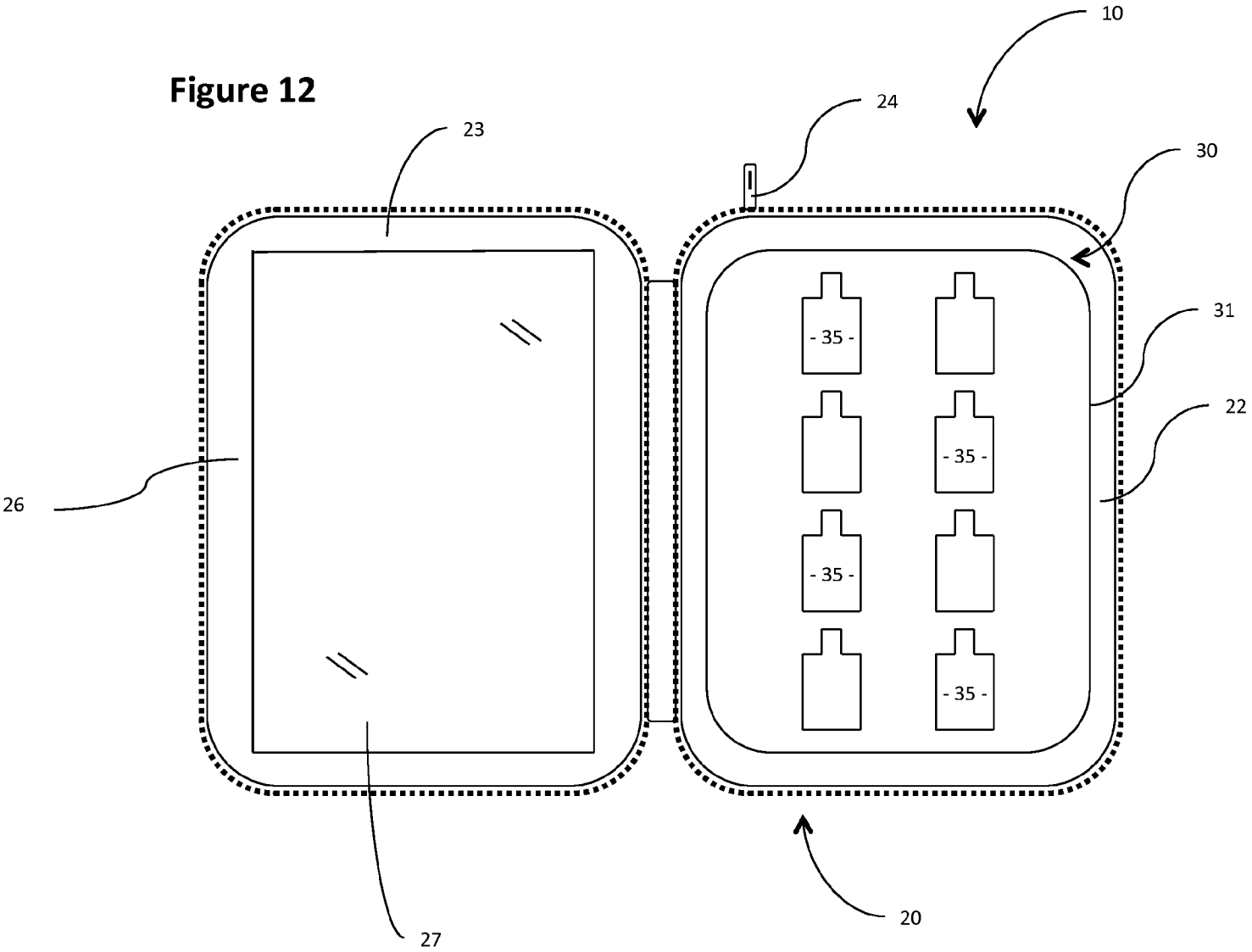
FIG. 12 is a plan view of an additional illustrative alternate embodiment of a universal nail polish storage and display assembly in accordance with the present invention.

Similar to FIG. 7, FIGS. 8, 9, 11, and 12 are illustrative of a universal nail polish storage and display assembly 10 in accordance with the present invention. As before, the assembly 10 comprises a case 20 having a storage unit 30 comprising a storage medium 31 mounted therein. The storage medium 31 has a plurality of storage compartments 35 formed therein, and wherein, once again, each of the plurality of storage compartments 35 is dimensioned and configured to receive a different one of a plurality of nail polish containers therein. Also similar to the embodiment of FIG. 7, each of the embodiments of the universal nail polish storage and display assembly 10 in accordance with FIGS. 8 and 9 include an accessory pouch 28 attached to cover 23, and FIG. 9 is further illustrative of an accessory pouch 28 having a plurality of grooming accessories contained therein. FIG. 11 is illustrative of an embodiment having a storage unit 30 comprises a storage medium 31 disposed in each side of a case 20. FIG. 12 is illustrative of an embodiment of a universal nail polish storage and display assembly 10 in accordance with the present invention wherein the cover 23 comprises a display frame 26 having a display window 27 mounted therein.

Figure 10:
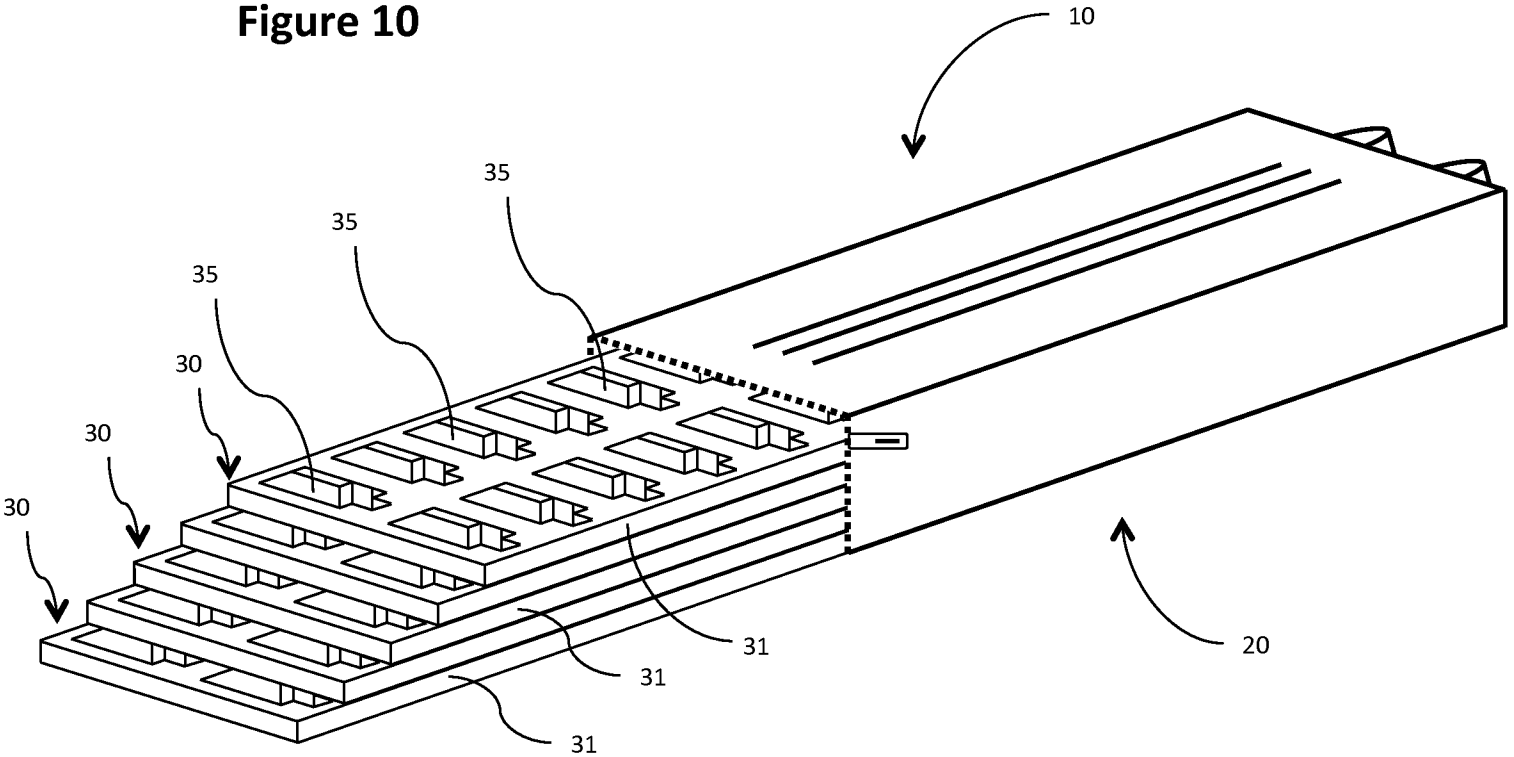
FIG. 10 is a perspective view of yet another illustrative embodiment of a universal nail polish storage and display assembly in accordance with the present invention.

Turning next to the illustrative embodiment of a universal nail polish storage and display assembly 10 as shown in FIG. 10, the assembly 10 again comprises a case 20 which, in the embodiment of FIG. 10, comprises a travel case having wheels or rollers mounted thereto to facilitate transport of the case 20, and its contents, by a user. In addition, the assembly 10 as shown in FIG. 10 comprises a plurality of storage units 30. As before, each of the plurality of storage units 30 comprises a storage medium 31 at least partially formed of a resilient material of construction. Further, each storage medium 31 comprises a plurality of storage compartments 35 therein, and as before, each of the plurality of storage compartments 35 is dimensioned and configured to receive and at least temporarily maintain a different one of a plurality of nail polish containers therein.

Since many modifications, variations and changes in detail can be made to the described embodiments of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A universal nail polish storage and display assembly for a plurality of nail polish containers wherein at least two of the plurality of nail polish containers each have a different configuration from one another, said assembly comprising:

a case having a base with a cover operatively interconnected thereto, said cover disposable between an open position and a closed position, a composite storage unit mounted in said base, wherein said composite storage unit comprises a storage medium having a plurality of members wherein said plurality of members includes a top layer and a bottom layer, the bottom layer located underneath the top layer, said storage medium comprising a plurality of storage compartments, each said storage compartment dimensioned and configured to receive a different one of the plurality of nail polish containers in an operative orientation therein wherein at least some of said plurality of storage compartments comprise a first upper portion and a first lower portion of the storage compartment defined by the top layer and a second upper portion and a second lower portion of the storage container defined by the bottom layer wherein the second upper and lower portions are larger in size than the first upper and lower portions so that an upper slot and a lower slot are formed within the bottom layer of the storage medium under the top layer wherein at least one of said slots is dimensioned to receive at least a portion of one of the plurality of nail polish containers therein, and said cover comprising a display frame dimensioned to permit each of the plurality of nail polish containers disposed in said operative orientation in corresponding ones of said plurality of storage compartments to be viewable while said cover is in said closed position.

2. The assembly as recited in claim 1 wherein at least some of said plurality of storage compartments comprise a lower slot disposed in communication therewith, said lower slot dimensioned to receive at least a portion of one of the plurality of nail polish containers therein.

3. The assembly as recited in claim 1 further comprising a display window mounted in said display frame, said display window comprising a substantially transparent material of construction.

4. The assembly as recited in claim 3 wherein said display window further comprises an ultraviolet resistant material of construction.

5. A universal nail polish storage and display assembly for a plurality of nail polish containers wherein at least two of the plurality of nail polish containers each have a different configuration from one another, said assembly comprising:

a case having a base with a cover operatively interconnected thereto, said cover disposable between an open position and a closed position, a composite storage unit mounted in said base, wherein said composite storage unit comprises a storage medium having a plurality of members wherein said plurality of members includes a top layer and a bottom layer, the bottom layer located underneath the top layer, wherein at least one of said members comprises a resilient material of construction, said storage medium comprising a plurality of storage compartments, each said storage compartment dimensioned and configured to receive a different one of the plurality of nail polish containers in an operative orientation therein, each of said plurality of storage compartments comprising a first upper portion and a first lower portion of the storage compartment defined by the top layer and a second upper portion and a second lower portion of the storage container defined by the bottom layer wherein the second upper and lower portions are larger in size than the first upper and lower portions so that an upper slot and a lower slot are formed within the bottom layer of the storage medium under the top layer wherein at least one of said slots is dimensioned to receive at least a portion of one of the plurality of nail polish containers therein, and said cover comprising a display frame, wherein a user can clearly view each of the plurality of nail polish containers disposed in an operative orientation in said support assembly while said cover is in said closed position.

6. The assembly as recited in claim 5 wherein said slot of each of said plurality of storage compartments comprises an upper slot.

7. The assembly as recited in claim 5 wherein said slot of each of said plurality of storage compartments comprises a lower slot.

8. The assembly as recited in claim 6 further comprising a lower slot disposed in communication with the storage compartment, said lower slot dimensioned to receive at least a portion of one of the plurality of nail polish containers therein.

9. The assembly as recited in claim 5 wherein said storage medium comprises a first member and a second member, said first member and said second member being cooperatively structured to define said plurality of storage compartments when disposed in an operatively attached orientation with one another.

10. The assembly as recited in claim 9 wherein said storage medium further comprises a backing member attached to said second member.

11. A composite storage unit for a plurality of nail polish containers, said composite storage unit comprising:

a storage medium comprising a first member, a second member, and a backing member operatively attached to one another in that order wherein each member has a longitudinal axis and the second member is disposed over the backing member and is in contact therewith and the first member is disposed over the second member and is in contact therewith but is not in contact with the backing member so that the longitudinal axis of each member is parallel with the longitudinal axis of the other members, said storage medium comprising a plurality of storage compartments, each said storage compartment dimensioned and configured to receive a different one of the plurality of nail polish containers in an operative orientation therein wherein at least said first member and said second member are cooperatively structured to define said plurality of storage compartments when disposed in an operatively attached orientation with one another wherein the first member defines a first upper portion and a first lower portion of the storage compartment and the second member defines a second upper portion and a second lower portion of the storage container wherein the second upper and lower portions are larger in size than the first upper and lower portions so that an upper slot and a lower slot are formed within the bottom layer of the storage medium under the first member.

12. The composite storage unit as recited in claim 11 wherein each of said upper slot is dimensioned to receive at least a portion of one of the plurality of nail polish containers therein.

13. The composite storage unit as recited in claim 12 wherein each of said lower slot is dimensioned to receive at least a portion of one of the plurality of nail polish containers therein.

14. The composite storage unit as recited in claim 13 wherein each of said first member, said second member, and said backing member comprise an open cell polyurethane foam material of construction.

15. The composite storage unit as recited in claim 11 further comprising a plurality of scores disposed between adjacent ones of said plurality of storage compartments thereby permitting at least one individual storage compartment to be separated from said storage medium.

16. The unit as recited in claim 11 wherein said storage medium further comprises a cover member attached to said first member.

17. The unit as recited in claim 16 wherein each of said first member and said second member comprise an open cell polyurethane foam material of construction, and each of said backing member and said cover member comprise an ethylene-vinyl acetate foam material of construction.

* * * * *